US011709516B2

(12) United States Patent
Teh

(10) Patent No.: US 11,709,516 B2
(45) Date of Patent: Jul. 25, 2023

(54) POWER SUPPLY CIRCUIT

(71) Applicants: Kabushiki Kaisha Toshiba, Tokyo (JP); Toshiba Electronic Devices & Storage Corporation, Tokyo (JP)

(72) Inventor: Chen kong Teh, Ota Tokyo (JP)

(73) Assignees: KABUSHIKI KAISHA TOSHIBA, Tokyo (JP); TOSHIBA ELECTRONIC DEVICES & STORAGE CORPORATION, Tokyo (JP)

( * ) Notice: Subject to any disclaimer, the term of this patent is extended or adjusted under 35 U.S.C. 154(b) by 0 days.

(21) Appl. No.: 17/670,165

(22) Filed: Feb. 11, 2022

(65) Prior Publication Data

US 2023/0099788 A1 Mar. 30, 2023

(30) Foreign Application Priority Data

Sep. 24, 2021 (JP) ..... 2021-155491

(51) Int. Cl.
*G05F 1/59* (2006.01)

(52) U.S. Cl.
CPC ..... *G05F 1/59* (2013.01)

(58) Field of Classification Search
CPC ..... G05F 1/59
See application file for complete search history.

(56) References Cited

U.S. PATENT DOCUMENTS

| | | | | |
|---|---|---|---|---|
| 8,957,652 | B2 | 2/2015 | Yamauchi | |
| 9,474,124 | B2 | 10/2016 | Yamauchi | |
| 9,820,352 | B2 | 11/2017 | Yamauchi | |
| 10,034,347 | B2 | 7/2018 | Yamauchi | |
| 11,556,143 | B2 * | 1/2023 | Shreepathi Bhat | G05F 1/575 |
| 2002/0180418 | A1 * | 12/2002 | Jones | G01R 19/0092 324/118 |
| 2020/0064876 | A1 * | 2/2020 | Ogura | G05F 1/575 |
| 2021/0064071 | A1 * | 3/2021 | Kadowaki | H03F 3/45475 |
| 2022/0350357 | A1 * | 11/2022 | Shashwat | G05F 1/59 |

FOREIGN PATENT DOCUMENTS

| | | | |
|---|---|---|---|
| JP | 4082355 | B2 | 4/2008 |
| JP | 5608544 | B2 | 10/2014 |
| JP | 5793979 | B2 | 10/2015 |

* cited by examiner

*Primary Examiner* — Kyle J Moody
*Assistant Examiner* — Lakaisha Jackson
(74) *Attorney, Agent, or Firm* — Allen & Overy LLP

(57) ABSTRACT

A power supply circuit in an embodiment includes a series circuit of a first resistor and a second transistor, the series circuit being connected in parallel to a first transistor between an input terminal and an output terminal, a third transistor configured to output an electric current corresponding to an electric current flowing to the first resistor, a third resistor configured to generate a voltage corresponding to the electric current, and a second operational amplifier configured to output a signal corresponding to a voltage difference between the voltage and a reference voltage to a gate of the first transistor and a gate of the second transistor.

7 Claims, 3 Drawing Sheets

POWER SUPPLY CIRCUIT

CROSS-REFERENCE TO RELATED APPLICATIONS

This application is based upon and claims the benefit of priority from the prior Japanese Patent Application No. 2021-155491 filed in Japan on Sep. 24, 2021; the entire contents of which are incorporated herein by reference.

FIELD

Embodiments described herein relate generally to a power supply circuit.

BACKGROUND

A power supply circuit includes a current limit circuit. For example, the current limit circuit includes a current detection circuit that detects an output current using an operational amplifier. The current limit circuit detects an electric current flowing to an output terminal and limits the output current such that the detected electric current does not increase to a predetermined value or more.

However, when an output voltage VOUT of the power supply circuit decreases to near 0 volts, the current detection circuit sometimes cannot appropriately detect the output current. When the output current cannot be appropriately detected, the current limit circuit cannot appropriately limit the output current.

DETAILED DESCRIPTION

A power supply circuit in an embodiment includes: a first transistor connected between an input terminal and an output terminal; a series circuit of a first resistor and a second transistor, the series circuit being connected in parallel to the first transistor between the input terminal and the output terminal; a second resistor, one end of which is connected to the input terminal; a first operational amplifier including a first input to which another end of the second resistor is connected and a second input to which a connection node of the first resistor and the second transistor is connected, the first operational amplifier outputting a first signal corresponding to a first voltage difference between the first input and the second input; a third transistor configured to output an electric current corresponding to the first signal output from the first operational amplifier; a third resistor configured to generate a voltage corresponding to the electric current; and a second operational amplifier including a third input to which the voltage is input and a fourth input to which a reference voltage is input, the second operational amplifier outputting a second signal corresponding to a second voltage difference between the third input and the fourth input, to a gate of the first transistor and a gate of the second transistor.

Embodiments are explained below with reference to the drawings.

First Embodiment (Configuration)

Figure 1:
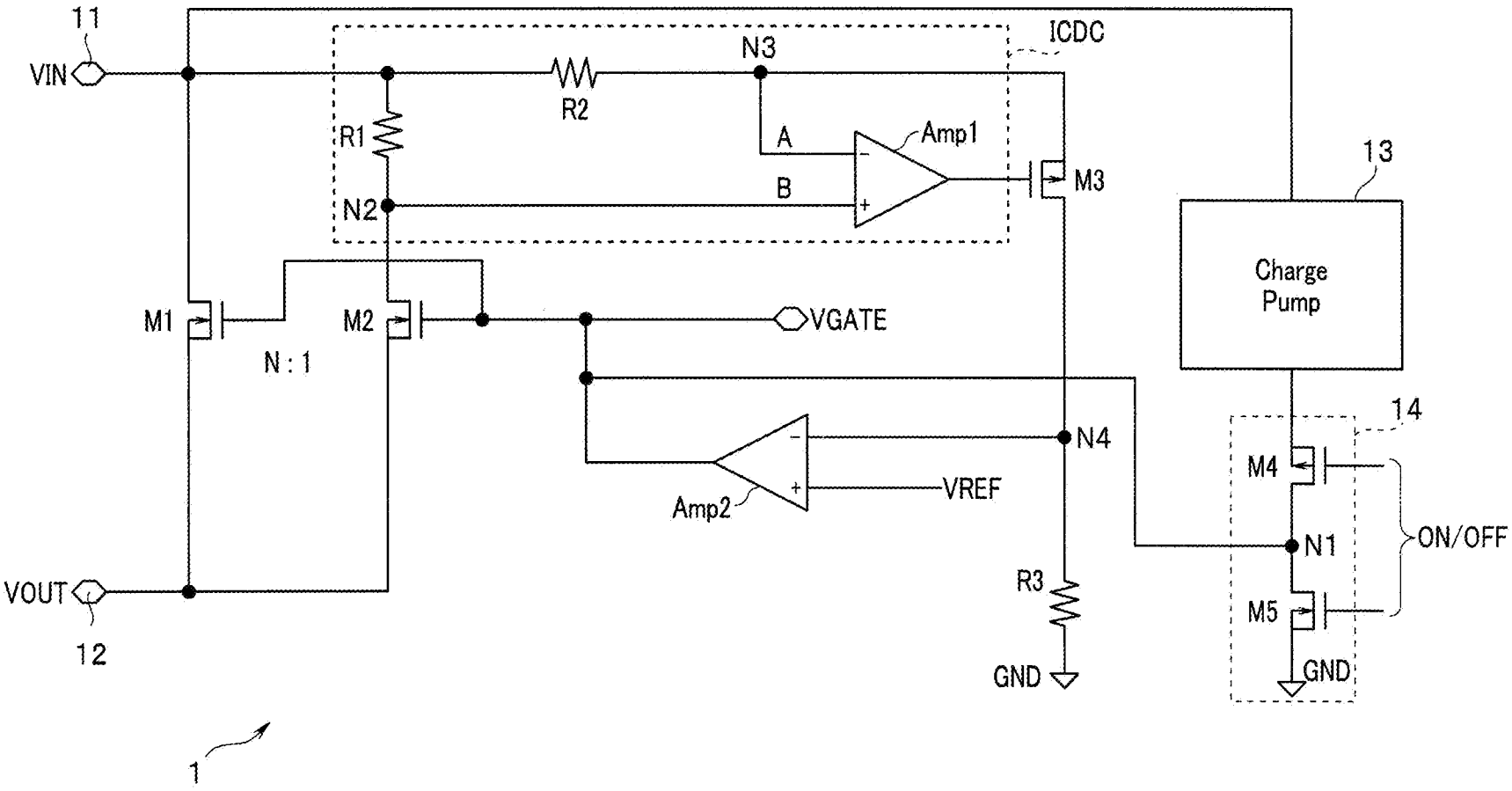
FIG. 1 is a circuit diagram of a power supply circuit according to a first embodiment.

FIG. 1 is a circuit diagram of a power supply circuit according to the present embodiment. A power supply circuit 1 includes an input terminal 11 to which an input voltage YIN is supplied as a power supply from an outside, an output terminal 12 that outputs an output voltage VOUT, a charge pump circuit 13, an ON/OFF input circuit 14, transistors M1, M2, and M3, operational amplifiers Amp1 and Amp2, and resistors R1, R2, and R3. The transistors M1 and M2 are NMOS transistors and the transistor M3 is a PMOS transistor.

The transistor M1 is connected between the input terminal 11 and the output terminal 12. A drain of the transistor M1 is connected to the input terminal 11 and a source of the transistor M1 is connected to the output terminal 12.

A series circuit of the resistor R1 and the transistor M2 is also connected between the input terminal 11 and the output terminal 12. A drain of the transistor M2 is connected to the input terminal 11 via the resistor R1 and a source of the transistor M2 is connected to the output terminal 12.

In other words, the transistor M1 and the series circuit of the resistor R1 and the transistor M2 are connected in parallel between the input terminal 11 and the output terminal 12.

The transistors M1 and M2 have a size ratio at which a current value of an electric current flowing to the transistor M1 is N times as large as a current value of an electric current flowing to the transistor M2. In FIG. 1, "N:1" indicates a ratio of two electric currents flowing to the transistors M1 and M2.

The sources of the transistors M1 and M2 are connected to the common output terminal 12. A gate of the transistor M1 and a gate of the transistor M2 are connected. Since a gate-source voltage Vgs applied between the source and the gate of the transistor M1 and a gate-source voltage Vgs applied between the source and the gate of the transistor M2 are equal, the transistors M1 and M2 configure a current mirror circuit.

The ON/OFF input circuit 14 includes a transistor M4 and a transistor M5 connected in series. The transistor M4 is a PMOS transistor and the transistor M5 is an NMOS transistor. A source of the transistor M4 is connected to an output of the charge pump circuit 13. A source of the transistor M5 is connected to ground potential GND. An input of the charge pump circuit 13 is connected to the input terminal 11. The charge pump circuit 13 generates a predetermined voltage and outputs the predetermined voltage to the ON/OFF input circuit 14.

A voltage in a connection node N1 of a drain of the transistor M4 and a drain of the transistor M5 changes according to an ON/OFF input to the ON/OFF input circuit 14. When the voltage in the connection node N1 changes to High, the transistors M1 and M2 are turned on and the output voltage VOUT is output from the output terminal 12 of the power supply circuit 1.

A connection node N2 of the resistor R1 and the drain of the transistor M2 is connected to a noninverting input terminal of the operational amplifier Amp1.

One end of the resistor R2 is connected to the input terminal 11. The other end of the resistor R2 is connected to the source of the transistor M3. A connection node N3 of the other end of the resistor R2 and the source of the transistor M3 is connected to an inverting input terminal of the operational amplifier Amp1. Accordingly, the operational amplifier Amp1 includes a first input to which the other end of the resistor R2 is connected and a second input to which the connection node N2 of the resistor R1 and the transistor M2 is connected. The operational amplifier Amp1 outputs a signal corresponding to a voltage difference between the first input and the second input.

An output of the operational amplifier Amp1 is connected to a gate of the transistor M3. The resistor R3 is connected between a drain of the transistor M3 and the ground potential GND.

The operational amplifier Amp1 controls the transistor M3 such that an input voltage A of the inverting input terminal and an input voltage B of the noninverting input terminal become equal. The transistor M3 outputs an electric current corresponding to a signal output from the operational amplifier. Amp1. A resistance value of the resistor R1 and a resistance value of the resistor R2 are equal. Therefore, an electric current flowing to the transistor M3 is equal to an electric current flowing to the resistor R1 and flows to the resistor R3 as well. Accordingly, the resistor R3 generates a voltage corresponding to the electric current flowing to the resistor R1.

An inverting input of the operational amplifier Amp2 is connected to a connection node N4 of the drain of the transistor M3 and one end of the resistor R3. A predetermined reference voltage VREF is input to the noninverting input of the operational amplifier Amp2. An output of the operational amplifier Amp2 is connected to the gates of the transistors M1 and M2. Accordingly, the operational amplifier Amp2 includes a first input to which a voltage generated in the connection node N4 is input and a second input to which the reference voltage VREF is input. The operational amplifier Amp2 outputs a signal corresponding to a voltage difference between the first and second inputs to the gate of the transistor M1 and the gate of the transistor M2.

Figure 2:
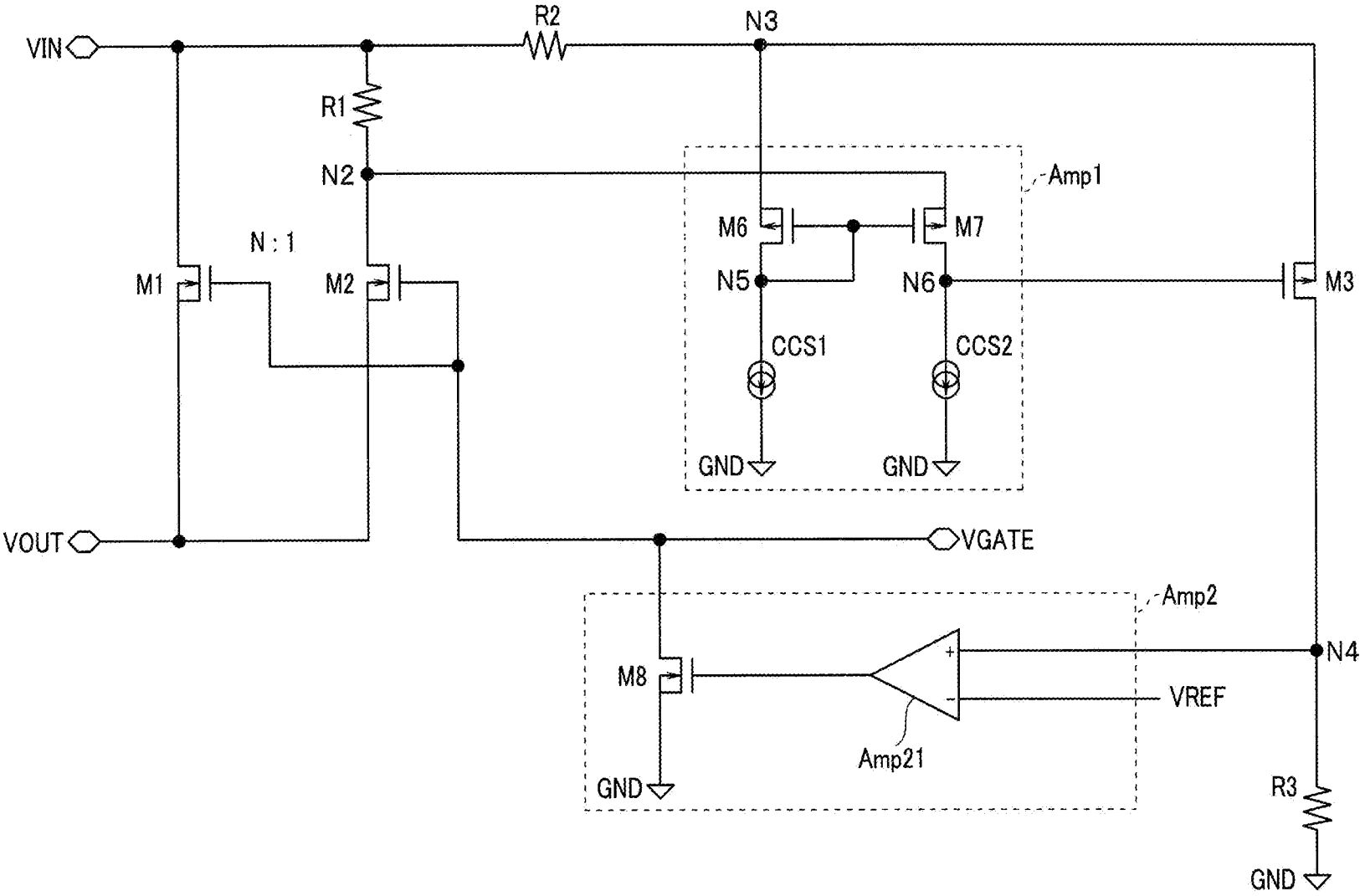
FIG. 2 is a circuit diagram of the power supply circuit showing internal circuits of two operational amplifiers according to the first embodiment.

FIG. 2 is a circuit diagram of the power supply circuit 1 showing internal circuits of the operational amplifiers Amp1 and Amp2. As shown in FIG. 2, the operational amplifier Amp1 includes two transistors M6 and M7 and two constant current sources CCS1 and CCS2. Both of the two transistors M6 and M7 are PMOS transistors.

A source of the transistor M6 is connected to the connection node N3. A source of the transistor M7 is connected to the connection node N2. A gate of the transistor M6 and a gate of the transistor M7 are connected.

The constant current source CCS1 is connected between a drain of the transistor M6 and the ground potential GND. The constant current source CCS2 is connected between a drain of the transistor M7 and the ground potential GND.

A connection node N5 of the drain of the transistor M6 and the constant current source CCS1 is connected to the gate of the transistor M6 and the gate of the transistor M7. Accordingly, the transistors M6 and M7 configure a current mirror circuit.

A connection node N6 of the drain of the transistor M7 and the constant current source CCS2 is connected to the gate of the transistor M3.

The operational amplifier Amp1 operates such that a gate-source voltage Vgs applied between the source and the gate of the transistor M6 and a gate-source voltage Vas applied between the source and the gate of the transistor M7 become equal.

For example, when the gate-source voltage Vgs of the transistor M7 changes to be larger than the gate-source voltage Vgs of the transistor M6, ON resistance of the transistor M7 decreases and a gate voltage of the transistor M3 increases. As a result, ON resistance of the transistor M3 increases and the electric current flowing to the transistor M3 decreases.

As a result, since a source voltage of the transistor M6 increases, the gate-source voltage Vgs of the transistor M6 increases and the gate-source voltage Vgs of the transistor M6 and the gate-source voltage Vgs of the transistor M7 become equal.

In this way, the operational amplifier Amp1 operates such that the gate-source voltage Vgs applied between the source and the gate of the transistor M6 and the gate-source voltage Vgs applied between the source and the gate of the transistor M7 become equal.

The operational amplifier Amp2 includes an operational amplifier Amp21 and a transistor M8, The transistor M8 is an NMOS transistor.

The connection node N4 is connected to a noninverting input terminal of the operational amplifier Amp21. The reference voltage VREF is input to an inverting input terminal of the operational amplifier Amp21. An output of the operational amplifier Amp21 is connected to a gate of the transistor M8, which is the NMOS transistor. A drain of the transistor M8 is connected to the gate of the transistor M1 and the gate of the transistor M2.

The two resistors R1 and R2 connected to the input terminal 11 and the operational amplifier Amp1, the two inputs of which are connected to the connection nodes N2 and N3, configure an input current detection circuit ICDC that detects an input current. In other words, the input current detection circuit ICDC detects an input current input from the input terminal 11. The transistor M3 outputs an electric current corresponding to the input current detected by the input current detection circuit ICDC.

A voltage corresponding to a current value detected by the input current detection circuit ICDC is compared with the reference voltage by the operational amplifier Amp2. Gate voltages of the transistors M1 and M2 are adjusted based on a result of the comparison.

(Action)

An operation of the power supply circuit 1 explained above is explained.

When the power supply circuit 1 is turned on, the transistors M1 and M2 are turned on and the output voltage VOUT is generated in the output terminal 12. The electric current flowing to the transistor M2 flows to the resistor R1 as well.

Since a pair of the transistors M1 and M2 configures the current mirror circuit, the current value of the electric current flowing to the transistor M1 and the current value of the electric current flowing to the transistor M2 are proportional to each other. The operational amplifier Amp1 controls the transistor M3 such that a voltage B in the connection node N2 and a voltage A in the connection node N3 become equal. In other words, the electric current flowing to the resistor R1 and an electric current flowing to the resistor R2 are controlled to become equal.

Since the electric current flowing to the transistor M3 flows to the resistor R3 as well, a voltage corresponding to the electric current flowing to the transistor M2 is generated in the connection node N4. The operational amplifier Amp21 controls gate voltages (VGATE) of the transistors M1 and M2 such that the voltage in the connection node N4 becomes equal to the reference voltage VREF.

Accordingly, for example, when an electric current flowing to a circuit connected to the output terminal 12 increases and an input current increases, the operational amplifier Amp21 reduces the gate voltages (VGATE) of the transistors M1 and M2 and limits an amount of the electric current flowing to the transistor M1.

As explained above, the input current detection circuit ICDC detects an electric current input from the input terminal 11. The electric currents flowing to the transistors M1 and M2 are controlled such that a voltage corresponding to the detected electric current coincides with the reference voltage VREF. Even if the output voltage VOUT decreases and the electric currents flowing to the transistors M1 and M2 are about to increase, since the gates of the transistors M1 and M2 are controlled by the operational amplifier Amp2, an output current is limited to a limit value of an output current determined according to the reference voltage VREF.

As explained above, according to the present embodiment, it is possible to provide a power supply circuit that can appropriately perform current limitation even when an output voltage is near 0 volts.

Second Embodiment

In the first embodiment, the operational amplifier Amp1 is used in order to detect the electric current input from the input terminal 11. However, when an input offset is present between the two inputs of the operational amplifier Amp1, the electric current input from the input terminal 11 cannot be correctly detected. A second embodiment relates to a power supply circuit including an offset adjustment circuit for cancelling an input offset between the two inputs of the operational amplifier Amp1.

A configuration of a power supply circuit 1A in the present embodiment is substantially the same as the configuration of the power supply circuit 1 in the first embodiment. Therefore, the same components as the components in the first embodiment are denoted by the same reference numerals, signs, and the like and explanation of the components is omitted. Components different from the components in the first embodiment are explained.

Figure 3:
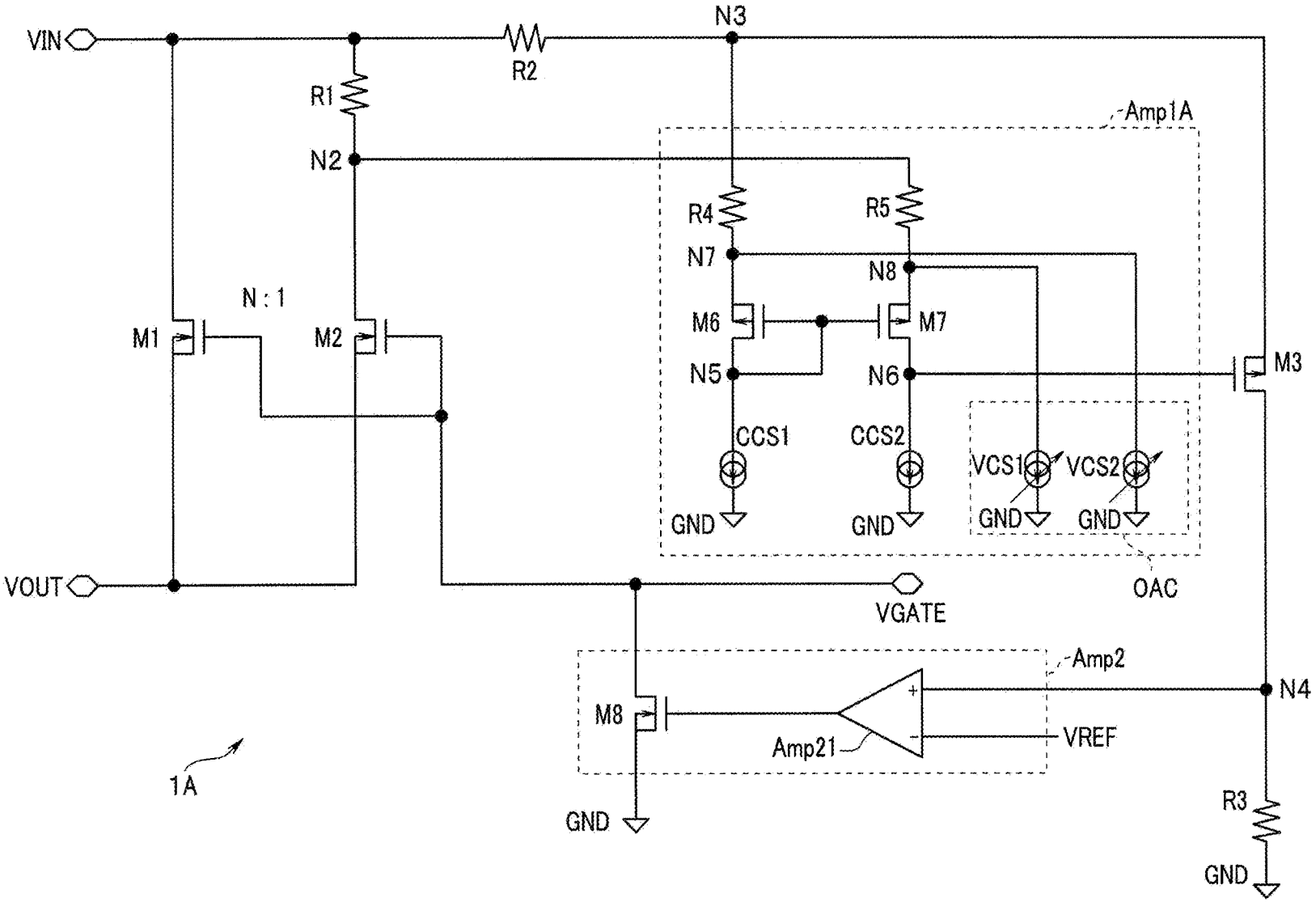
FIG. 3 is a circuit diagram of a power supply circuit according to a second embodiment.

FIG. 3 is a circuit diagram of the power supply circuit according to the present embodiment. Note that, in FIG. 3, the charge pump circuit 13 and the ON/OFF input circuit 14 shown in FIG. 1 are omitted.

The power supply circuit 1A shown in FIG. 3 includes an operational amplifier Amp1A. The operational amplifier Amp1A includes resistors R4 and R5 and an offset adjustment circuit OAC. The source of the transistor M6 of the operational amplifier Amp1A is connected to the connection node N3 via the resistor. R4. The source of the transistor M7 of the operational amplifier Amp1A is connected to the connection node N2 via the resistor R5.

The offset adjustment circuit OAC includes two variable current sources VCS1 and VCS2. One end of the variable current source VCS1 is connected to the ground potential GND and the other end of the variable current source VCS1 is connected to a connection node N8 of the source of the transistor M7 and the resistor R5. One end of the variable current source VCS2 is connected to the ground potential GND and the other end of the variable current source VCS2 is connected to a connection node N7 of the source of the transistor M6 and the resistor R4. The variable current source VCS1 draws in an electric current from the connection node N8. The variable current source VCS2 draws in an electric current from the connection node N7. Amounts of the electric currents drawn in by the variable current sources VCS1 and VCS2 are set in advance to cancel an input offset between two inputs of the operational amplifier Amp1A.

In other words, the operational amplifier Amp1A includes the offset adjustment circuit OAC that adjusts the input offset between the two inputs. Since the input offset between the two inputs of the operational amplifier Amp1A is cancelled by the offset adjustment circuit OAC, an electric current input from the input terminal 11 can be correctly detected.

The other operation is the same as the operation of the power supply circuit 1 explained in the first embodiment.

Note that, although the offset adjustment circuit OAC includes the two resistors R4 and R5 and the two variable current sources VCS1 and VCS2, the offset adjustment circuit OAC may include only one resistor and one variable current source. For example, a resistor is provided only on the source side of one of the transistors M6 and M7 and a variable current source is provided in a connection node of the resistor and the source of one of the transistors M6 and M7. The input offset between the two inputs of the operational amplifier Amp1A can be cancelled by adjusting an electric current drawn in by the variable current source.

Accordingly, according to the respective embodiments explained above, it is possible to provide a power supply circuit that can appropriately perform current limitation even when an output voltage is near 0 volts.

While certain embodiments have been described, these embodiments have been presented by way of example only, and are not intended to limit the scope of the inventions. Indeed, the novel circuits described herein may be embodied in a variety of other forms; furthermore, various omissions, substitutions and changes in the form of the circuits described herein may be made without departing from the spirit of the inventions. The accompanying claims and their equivalents are intended to cover such forms or modifications as would fall within the scope and spirit of the inventions.

What is claimed is:

1. A power supply circuit comprising:

a first transistor connected between an input terminal and an output terminal;

a series circuit of a first resistor and a second transistor, the series circuit being connected in parallel to the first transistor between the input terminal and the output terminal;

a second resistor, one end of the second resistor being connected to the input terminal;

a first operational amplifier including a first input to which another end of the second resistor is connected and a second input to which a connection node of the first resistor and the second transistor is connected, the first operational amplifier outputting a first signal corresponding to a first voltage difference between the first input and the second input;

a third transistor configured to output an electric current corresponding to the first signal output from the first operational amplifier;

a third resistor configured to generate a voltage corresponding to the electric current; and a second operational amplifier including a third input to which the voltage is input and a fourth input to which a reference voltage is input, the second operational amplifier outputting a second signal corresponding to a second voltage difference between the third input and the fourth input to a gate of the first transistor and a gate of the second transistor.

2. The power supply circuit according to claim 1, wherein the first operational amplifier includes an offset adjustment circuit configured to adjust an input offset between the first input and the second input.

3. The power supply circuit according to claim 1, wherein the first transistor and the second transistor are NMOS transistors.

4. The power supply circuit according to claim 1, wherein the third transistor is a PMOS transistor.

5. A power supply circuit comprising:

a first transistor connected between an input terminal and an output terminal;

an input current detection circuit configured to detect an input current input from the input terminal;

a second transistor configured to output an electric current corresponding to the input current detected by the input current detection circuit;

a resistor configured to generate a voltage corresponding to the electric current; and an operational amplifier including a first input to which the voltage is input and a second input to which a reference voltage is input, the operational amplifier outputting a signal corresponding to a voltage difference between the first input and the second input to a gate of the first transistor.

6. The power supply circuit according to claim 5, wherein the first transistor is an NMOS transistor.

7. The power supply circuit according to claim 5, wherein the second transistor is a PMOS transistor.

* * * * *